US007437823B2

(12) United States Patent
Yeh

(10) Patent No.: US 7,437,823 B2
(45) Date of Patent: Oct. 21, 2008

(54) HAIRDRESSING SCISSORS

(75) Inventor: Wen-Ya Yeh, Tainan (TW)

(73) Assignee: Yanni Co., Ltd., Tainan (TW)

( * ) Notice: Subject to any disclaimer, the term of this patent is extended or adjusted under 35 U.S.C. 154(b) by 262 days.

(21) Appl. No.: 11/212,055

(22) Filed: Aug. 24, 2005

(65) Prior Publication Data

US 2007/0044318 A1 Mar. 1, 2007

(51) Int. Cl.
*B26B 13/00* (2006.01)

(52) U.S. Cl. ..... 30/226; 30/195; 30/254

(58) Field of Classification Search ..... 30/195, 30/196, 197, 226, 227, 254, 260; 24/594.1, 24/594.11, 595.1, 629, 662, 664, 545, DIG. 38, 24/DIG. 43, DIG. 50, 457, 462, DIG. 41, 24/563; 403/329; 206/349, 509, 511; 220/23.4
See application file for complete search history.

(56) References Cited

U.S. PATENT DOCUMENTS

| | | | | | |
|---|---|---|---|---|---|
| 444,019 | A * | 1/1891 | Richards | 292/17 |
| 2,160,492 | A * | 5/1939 | Cook | 24/578.11 |
| 2,868,489 | A * | 1/1959 | Calcut | 248/229.26 |
| 3,809,799 | A * | 5/1974 | Taylor | 174/68.3 |
| 3,931,946 | A * | 1/1976 | Soltysik | 248/68.1 |
| 3,963,123 | A * | 6/1976 | Beal | 206/495 |
| 4,391,376 | A * | 7/1983 | Finnegan | 211/70.5 |
| 4,432,182 | A * | 2/1984 | Addie et al. | 52/480 |
| 4,778,320 | A * | 10/1988 | Nakama | 411/509 |
| 5,120,012 | A * | 6/1992 | Rosenau | 248/201 |
| 5,136,760 | A * | 8/1992 | Sano et al. | 24/457 |
| 5,957,421 | A * | 9/1999 | Barbour | 248/220.21 |
| 5,996,592 | A * | 12/1999 | Choy | 132/200 |
| 6,192,590 | B1 * | 2/2001 | Yeh | 30/226 |
| 6,234,676 | B1 * | 5/2001 | Galomb et al. | 383/63 |
| 6,353,978 | B1 * | 3/2002 | Kawahara et al. | 24/114.4 |
| 6,434,833 | B1 | 8/2002 | Yeh | |
| 6,607,224 | B2 * | 8/2003 | Hodges | 292/303 |
| 6,634,106 | B2 * | 10/2003 | Yeh | 30/226 |
| 2004/0123557 | A1 * | 7/2004 | Hornung et al. | 52/786.13 |
| 2005/0076484 | A1 * | 4/2005 | Sussenbach et al. | 24/662 |
| 2006/0260917 | A1 * | 11/2006 | Ozaki et al. | 198/853 |

* cited by examiner

*Primary Examiner*—Boyer D. Ashley
*Assistant Examiner*—Bharat C Patel
(74) *Attorney, Agent, or Firm*—Pro-Techtor Int'l Services

(57) ABSTRACT

A pair of hairdressing scissors comprises a first blade, a second blade pivotally secured to the first blade, at least two recesses formed at least one of the first and second blades, and at least a retainer fixed on at least one of the first and second blades. The retainer has two retaining portions each having an edge, two pairs of scissors are secured to each other in such a manner that an edge of a retainer of a first one of the two pairs of scissors is locked in two recesses of a second one of the two pairs of scissors.

3 Claims, 8 Drawing Sheets

HAIRDRESSING SCISSORS

BACKGROUND OF THE INVENTION

1. Field of the Invention

The present invention relates to a pair of hairdressing scissors, and more particularly to a pair of hairdressing scissors having connecting device formed on the handle portion thereof, so that plural pairs of such hairdressing scissors can be detachably secured to one another.

2. Description of the Prior Arts

A hairstylist cuts a customer's hair with several techniques, including trimming, thinning, layering, etc. Sometimes the hairstylist has to hold plural pairs of scissors in the same hand for proceeding with the thinning or layering of the hair to obtain the desired special hairstyle.

During operation of the plural pairs of scissors in the same hand, the user must keep the plural pairs of scissors be spaced at regular intervals and operate them with the same operating condition. The plural pairs of scissors must open and close synchronously to obtain a tidy, beautiful hairstyle. However, the plural pairs of scissors are simply held by the index finger and the thumb of the user such that the plural pairs of scissors cannot be operated synchronously due to touchy control of the plural pairs of scissors by the fingers. Thus, the plural pairs of scissors often become skew to one another and the spacing therebetween may be different from one another. The haircutting result is adversely affected, and this problem is aggravated if the user is inexperienced. The user often feels pain when operating the plural pairs of scissors in addition to numerous limitations to and difficulties in operation.

U.S. Pat. Nos. 6,192,590 B1, 6,434,833 B1 and 6,634,106 B2 disclose hairdressing scissor assemblies to solve the above-mentioned problems. These hairdressing scissor assemblies can be detachably engaged together so as to allow the hairstylist to use them as freely and easily as using one hairdressing scissor assembly.

The present invention has arisen to mitigate and/or obviate the afore-described disadvantages.

SUMMARY OF THE INVENTION

The primary objective of the present invention is to provide a pair of hairdressing scissors having connecting device formed on the handle portion thereof, so that plural pairs of such hairdressing scissors can be detachably secured to one another.

A pair of scissors in accordance with the present invention comprises:

a first blade;

a second blade pivotally secured to the first blade;

at least two recesses formed at least one of the first and second blades; and at least a retainer fixed on at least one of the first and second blades, the retainer having two retaining portions each having an edge, two pairs of scissors are secured to each other in such a manner that an edge of a retainer of a first one of the two pairs of scissors is locked in two recesses of a second one of the two pairs of scissors.

The two retaining portions each have a reverse U shape.

In each of the recess can be arranged a retaining pin, and the two retaining portions each have a V shape, so that two pairs of scissors are secured to each other in such a manner that two elastic retaining portions of a retainer of a first one of the two pairs of scissors are locked onto a retaining pin in each of two recesses of a second one of the two pairs of scissors.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
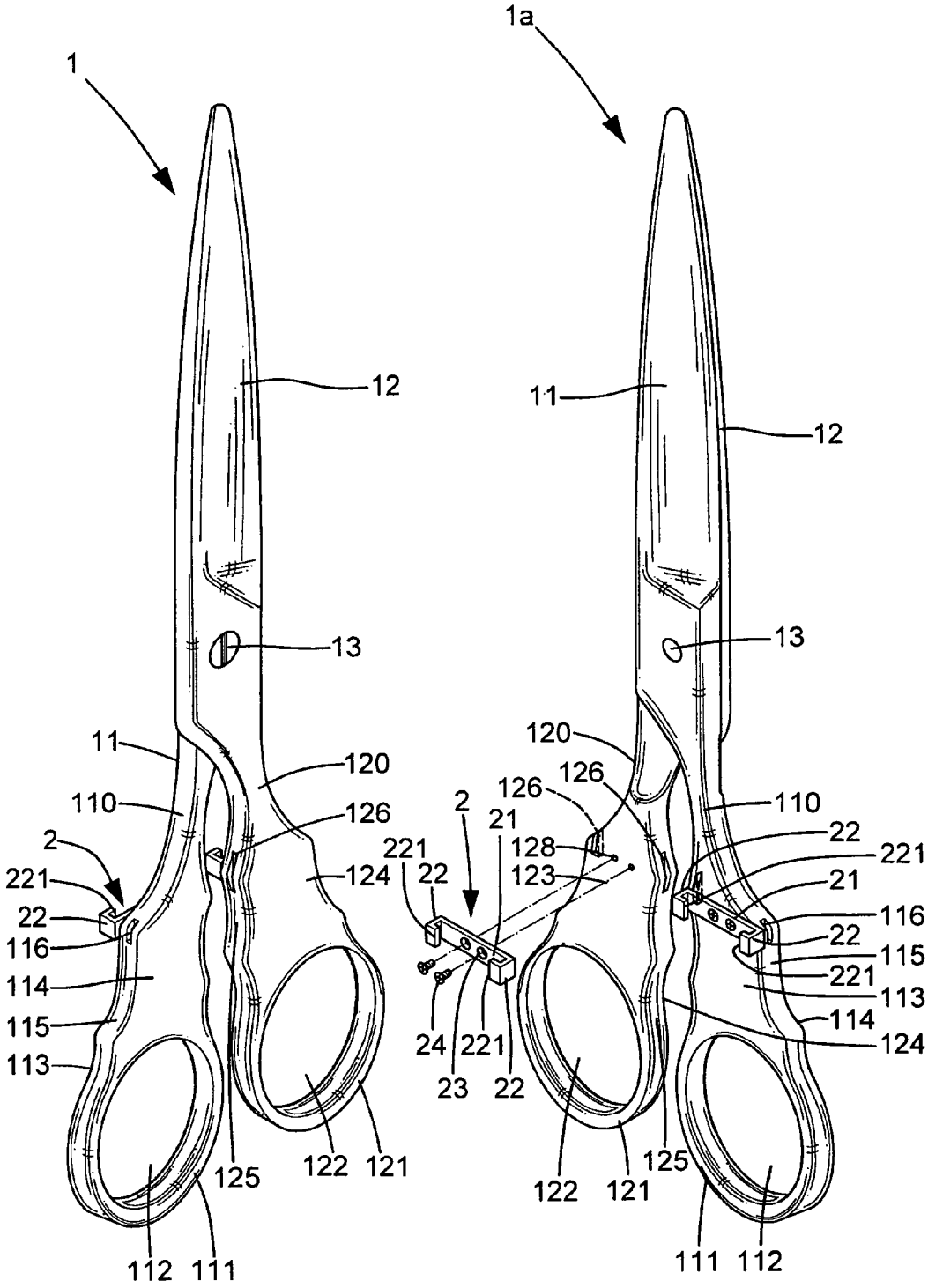
FIG. 1 is a perspective view of a pair of hairdressing scissors in accordance with a first embodiment of the present invention.
Figure 2:
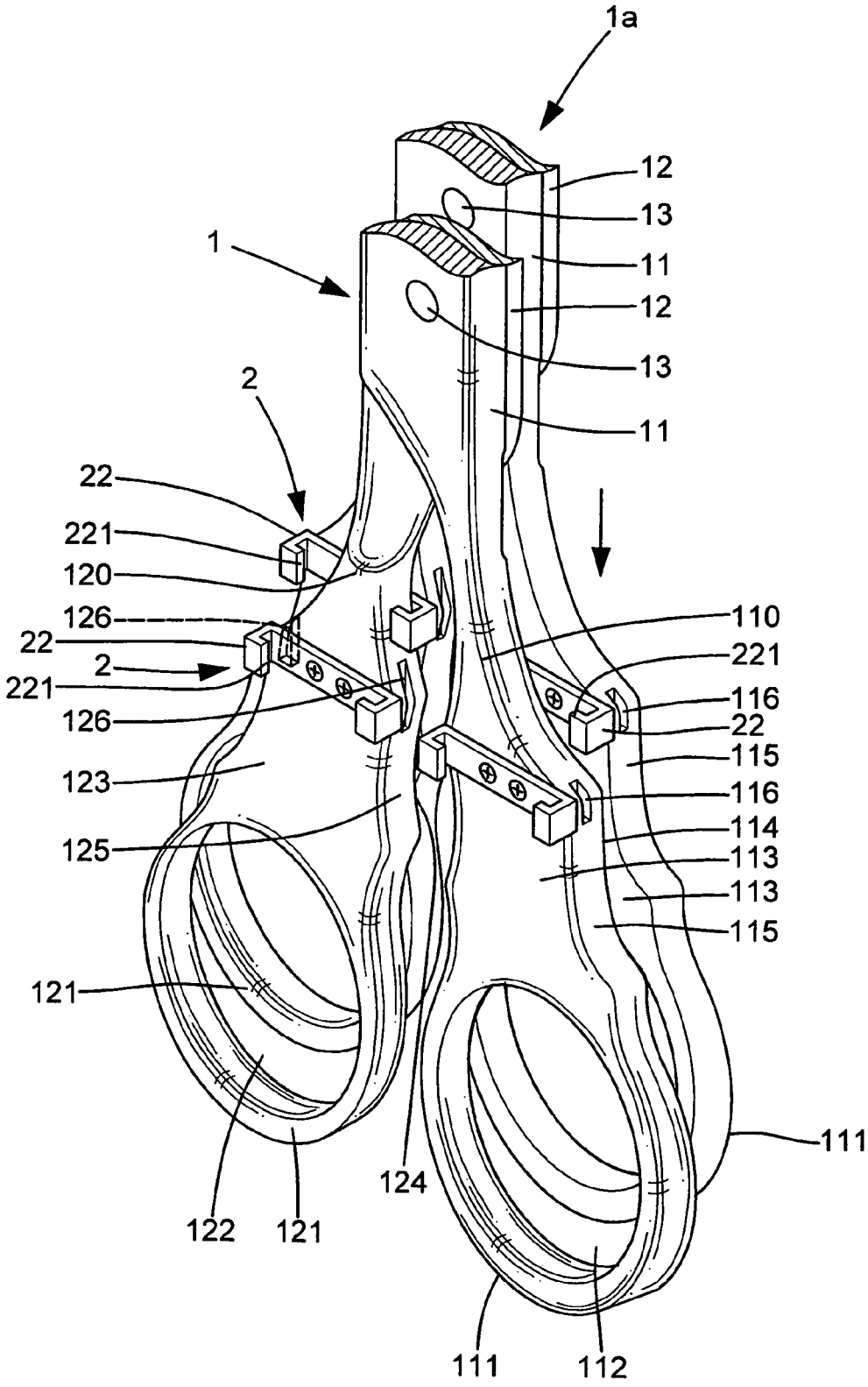
FIG. 2 shows that two pairs of hairdressing scissors 1 and 1*a* in accordance with the first embodiment are coupled together.

Referring to FIGS. 1 and 2, FIG. 1 is a perspective view of a pair of hairdressing scissors in accordance with a first embodiment of the present invention, and FIG. 2 shows that two pairs of hairdressing scissors 1 and 1*a* are coupled together. The two pairs of hairdressing scissors 1 and 1*a* each comprises a first blade 11 and a second blade 12 that each has a handle portion 111, 121 at an end thereof. The handle portions 111 and 121 are connected to the first and second blades 11 and 12 via a neck portion 110 and 120. Each of the handle portions 111 and 121 is defined with an opening 112 or 122 for the thumb or index finger of the user. A pivot 13 pivotally connects the first and second blades with each other.

The handle portions 111 and 121 each include a first surface 113 and 123, a second surface 114 and 124, two lateral surfaces 115, and two lateral surfaces 125.

At least one of the handle portions 111 and 121 of the pair of hairdressing scissors 1 is fixed at least a retainer 2 that includes a baseboard 21 having at least a through hole 23, the baseboard 21 is formed at both side thereof with a reverse U-shaped retaining portion 22 having an edge 221 extending toward the center of the baseboard 21. On the first surface 113 and 123 of the handle portions 111 and 121 are defined threaded holes 118 and 128 correspondingly to the through hole 23 of the retainer 2, so that the retainer 2 can be fixed to the first surface 113 and 123 of the handle portions 111 and 121 by screwing a fastener 24 through the through hole 23 into the threaded holes 118 and 128.

Figure 3:
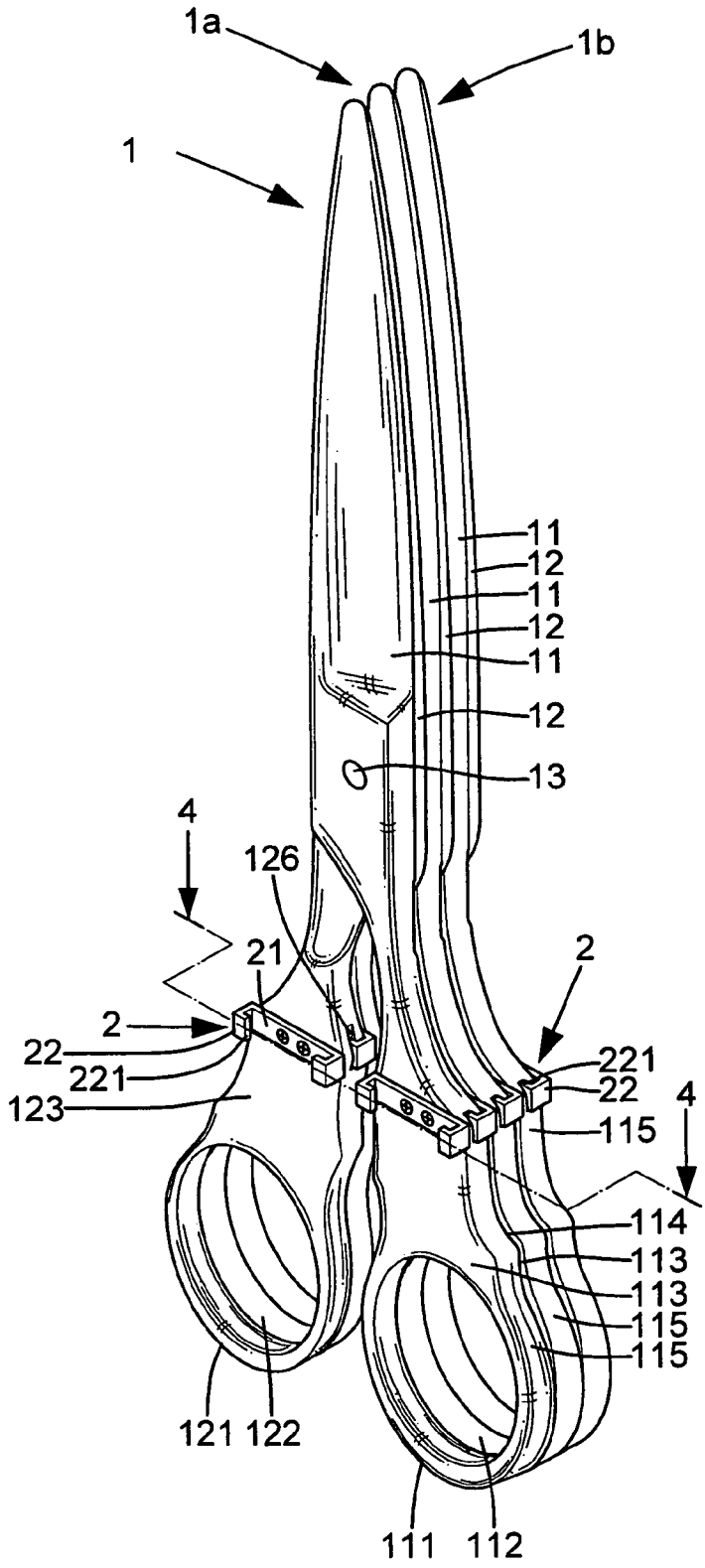
FIG. 3 shows that three pairs of hairdressing scissors are coupled to one another.
Figure 4:
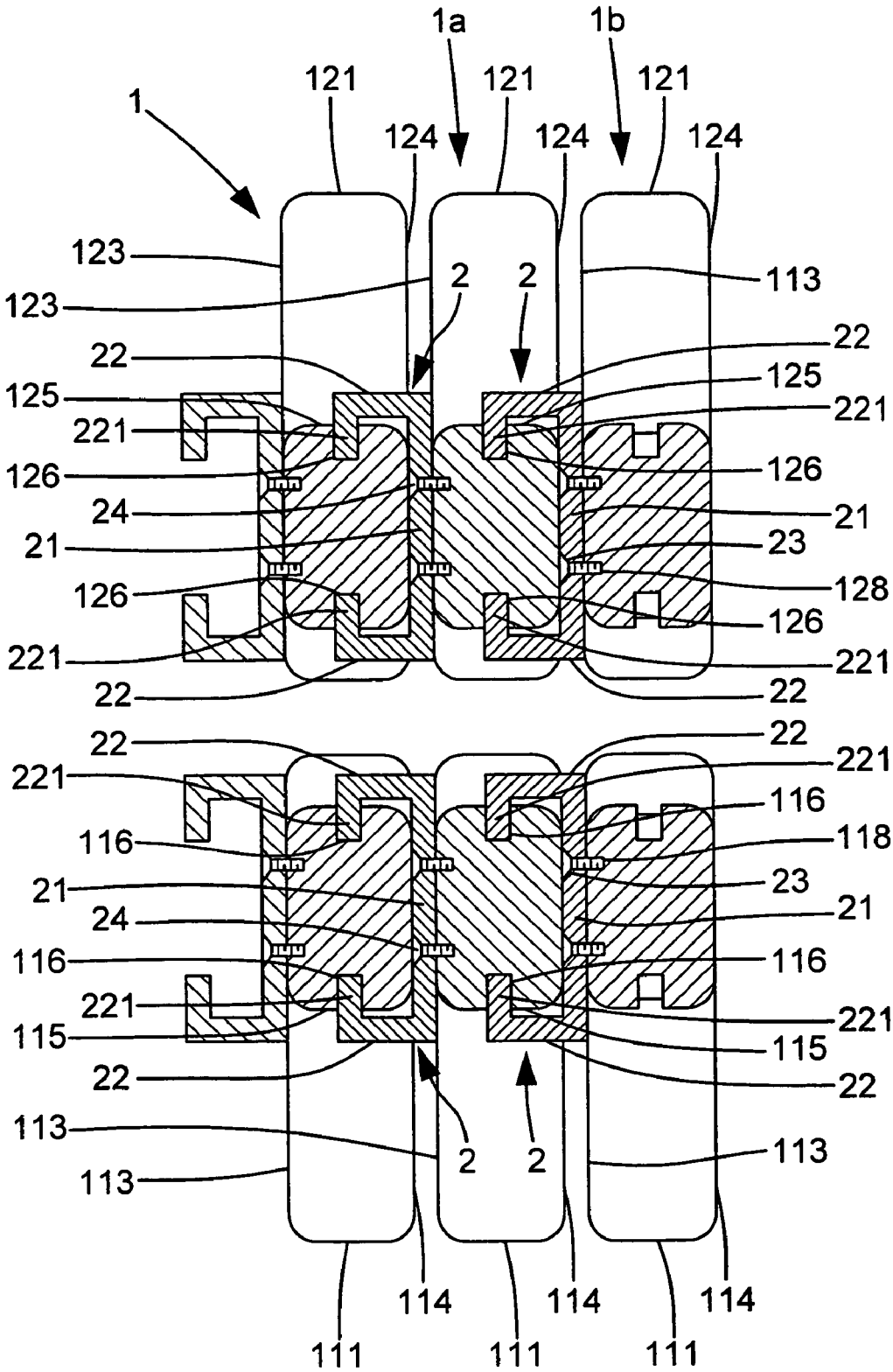
FIG. 4 is a cross section view taken along the line 4-4 of FIG. 3.

The handle portions 111 and 121 of the pair of hairdressing scissors 1 are defined with recesses 116 and 126 for engaging with the retainer 2, in this embodiment, the recesses 116 and 126 are located on the lateral surfaces 115 and 125, respectively. FIG. 3 shows that three pairs of hairdressing scissors are coupled to one another. FIG. 4 is a cross section view taken along the line 4-4 of FIG. 3. The two pairs of hairdressing scissors 1 and 1*a* are coupled to each other by the following steps: abutting the first surfaces 113 and 123 of the pair of hairdressing scissors 1*a* against the second surfaces 114 and 124 of the pair of hairdressing scissors 1 in such a manner that the retainer 2 of the pair of hairdressing scissors 1*a* is arranged above the recesses 116 and 126 and located at the neck portions 110 and 120 of the handle portions 111 and 121 of the hairdressing scissors 1; and then pushing down the hairdressing scissors 1*a* so as to insert the edge 221 of the retainer 2 into the recesses 116 and 126. Therefore, the two pairs of hairdressing scissors 1 and 1*a* are coupled to each other. By repeating the abovementioned steps, a plurality of pairs of scissors 1, 1*a* and 1*b* can be detachably locked together, as shown in FIGS. 3 and 4.

Figure 5:
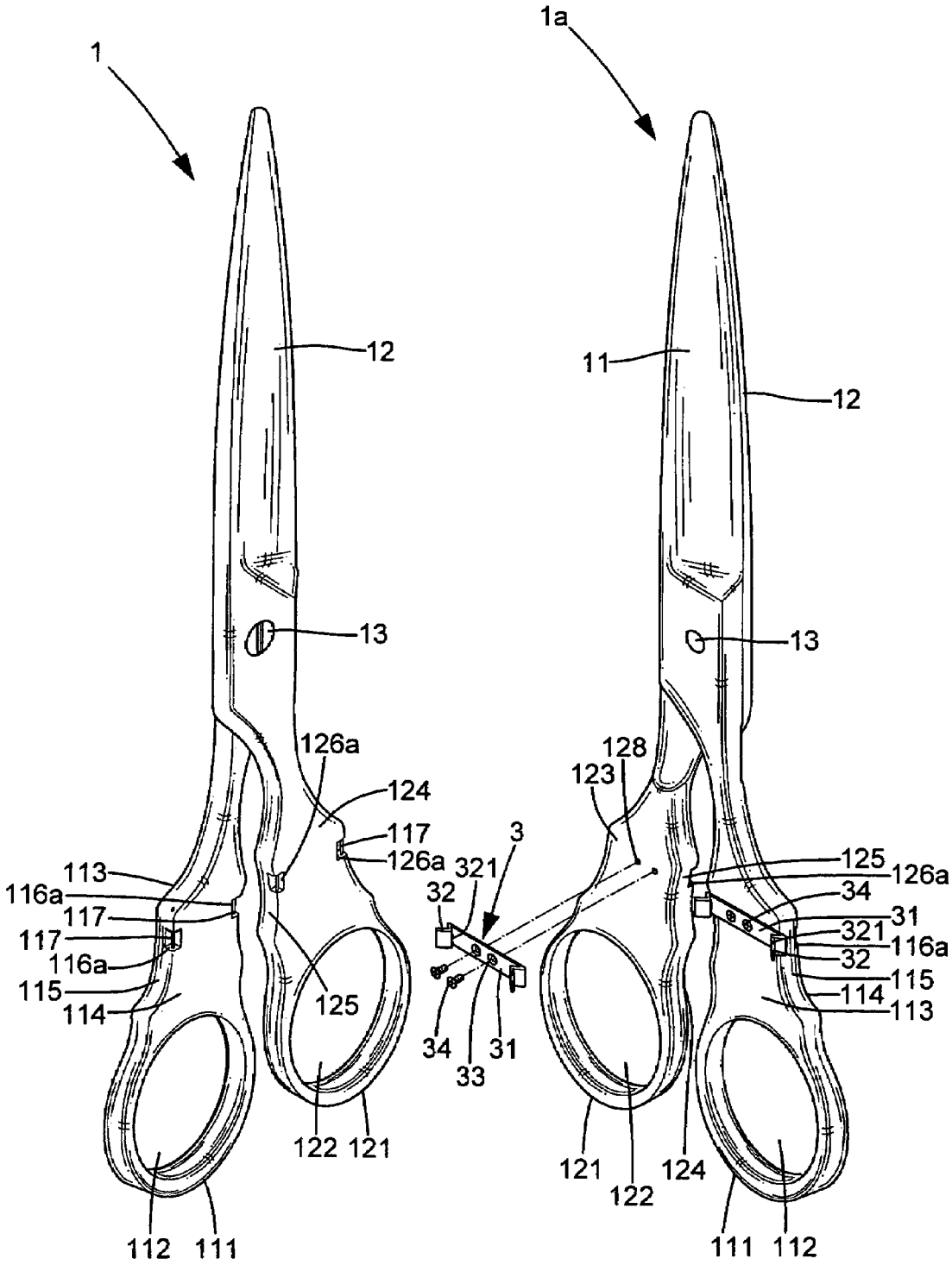
FIG. 5 is a perspective view of a pair of hairdressing scissors in accordance with the second embodiment of the present invention.
Figure 6:
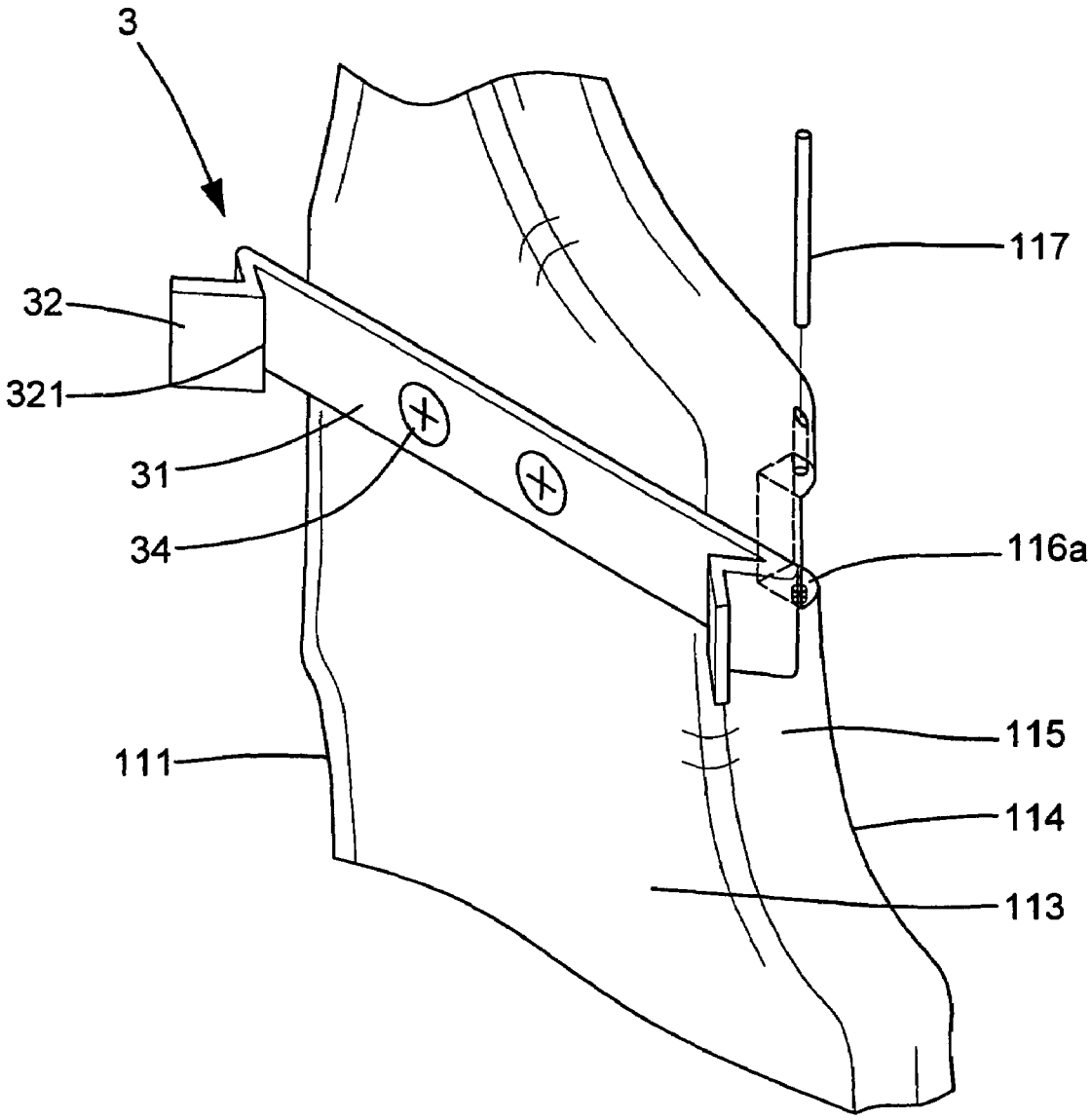
FIG. 6 is an enlarged view of a part of the pair of hairdressing scissors in accordance with the second embodiment of the present invention.

Referring further to FIGS. 5 and 6, which show a connecting structure for a pair of hairdressing scissors in accordance with a second embodiment of the present invention (components in this embodiment identical or equivalent to the first embodiment are indicated by the same reference number). FIG. 5 is a perspective view of a pair of hairdressing scissors in accordance with the second embodiment of the present invention, and FIG. 6 is an enlarged view of a part of the pair of hairdressing scissors in accordance with the second embodiment of the present invention.

Figure 8:
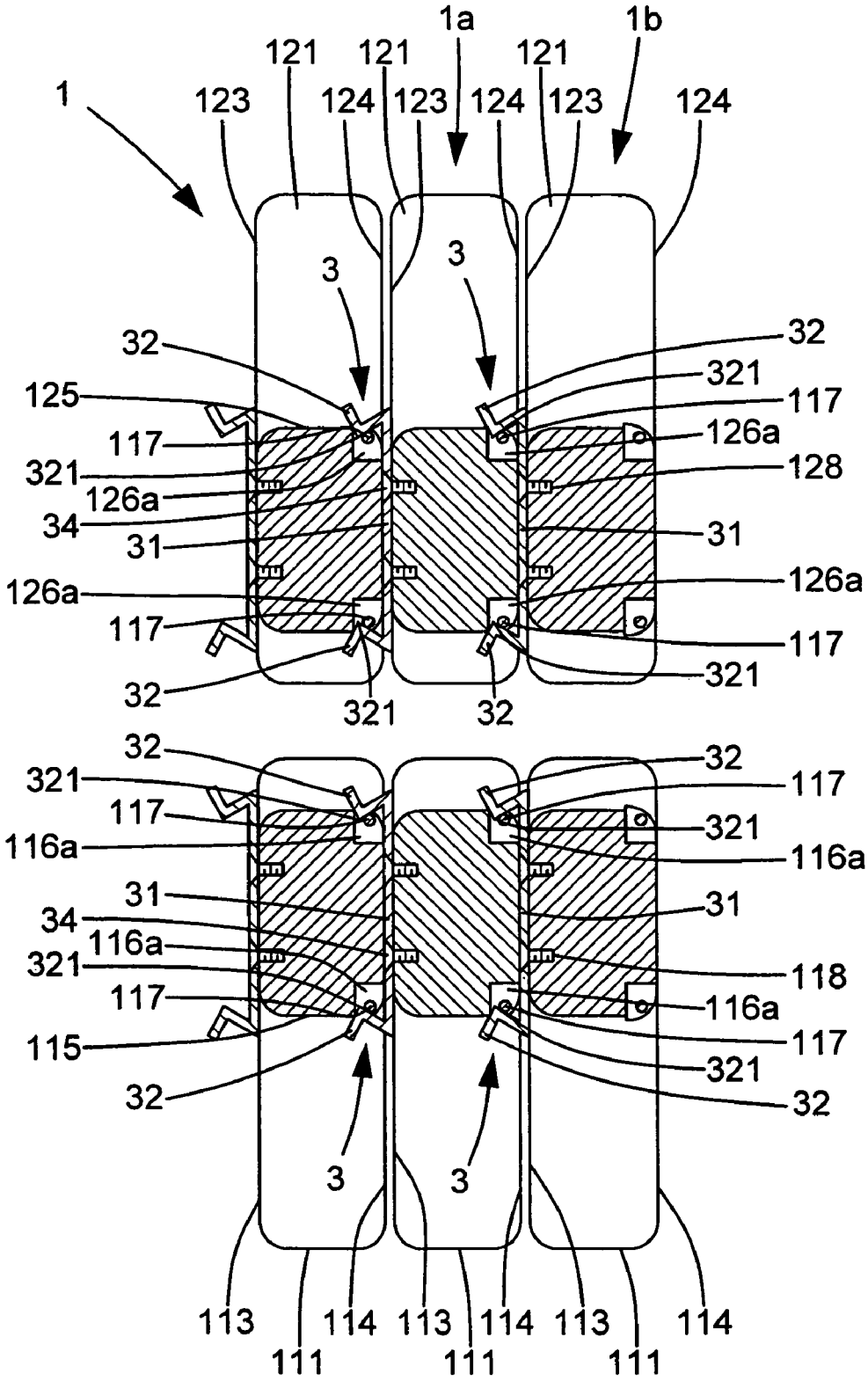
FIG. 8 is a cross section view taken along the line 8-8 of FIG. 7.

In this embodiment, the retainer 3 also includes a baseboard 31 on which is formed at least a through 33 for insertion of the fastener 34, so as to allow the retainer 3 to be fixed to the threaded holes 118 and 128 of the first surfaces 113 and 123 of the handle portions by the fastener 34, as shown in FIG. 8. The retainer 3 is made of thin metal sheet, and the baseboard 31 of the retainer 3 is provided at both sides thereof with a V-shaped retaining portion 32 that has a terminal end 321 extending toward the center of the retainer 3, so that the V-shaped retaining portion 32 has certain elasticity and flexibility. Recesses 116*a* and 126*a* are located at the corner between the second surface 114, 124 and the two lateral surfaces 115, 125 of the handle portions. In the respective recesses 116*a* and 126*a* is arranged a retaining pin 117.

Figure 7:
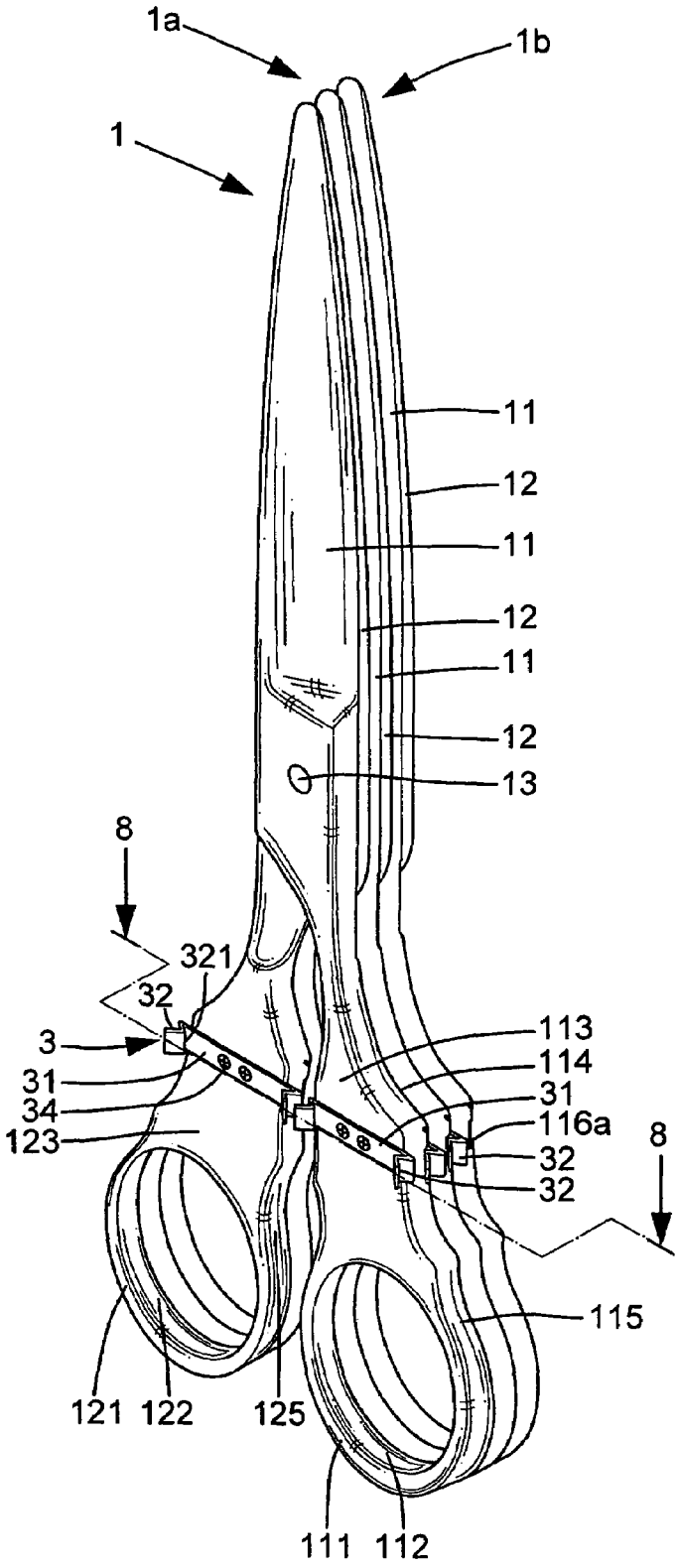
FIG. 7 shows that three pairs of hairdressing scissors 1, 1*a* and 1*b* in accordance with the second embodiment are coupled together.

With references to FIGS. 5, 7 and 8, the two pairs of hairdressing scissors 1 and 1*a* are also coupled to each other by: abutting the first surfaces 113 and 123 of the pair of hairdressing scissors 1*a* against the second surfaces 114 and 124 of the pair of hairdressing scissors 1 in such a manner that the retainer 3 of the pair of hairdressing scissors 1*a* is arranged above the recesses 116*a* and 126*a*; and then pressing the two pairs of hairdressing scissors 1*a* and 1 against each other, so that the retaining portion 32 of the retainer 3 will be flexibly forced onto the retaining pin 117 in the recesses 116*a* and 126*a*, as shown in FIG. 8. Therefore, the two pairs of hairdressing scissors 1 and 1*a* are coupled to each other, and may be disengaged by pressure applied in a direction lateral to the retaining pins.

The retainers 2 and 3 also can be fixed to the hairdressing scissors by rivet, welding, adhesive, and any other means.

While we have shown and described various embodiments in accordance with the present invention, it should be clear to those skilled in the art that further embodiments may be made without departing from the scope of the present invention.

What is claimed is:

1. A pair of hairdressing scissors comprising:

a first blade;

a second blade pivotally secured to the first blade;

at least a flexible elastic retainer fixed on at least one of the first and second blades, the retainer having two flexible elastic retaining portions; and at least two recesses formed on at least one of the first and second blades on a side opposite to the retainer, each recess having a retaining pin; and wherein said pair of scissors is securable to a substantially identical second pair of scissors in such a manner that two flexible elastic retaining portions of a retainer of said pairs of scissors are clipped onto a retaining pin in each of two recesses said substantially identical second pair of scissors and are disengageable by pressure applied in a direction lateral to the retaining pins.

2. The pair of hairdressing scissors as claimed in claim 1, wherein the two flexible retaining portions each have a V shape.

3. The pair of hairdressing scissors as claimed in claim 1, wherein the at least a retainer has a baseboard defined with at least a through hole, and at least a threaded hole is formed on at least one of the first and second blades, so that the retainer is fixed to the at least one of the first and second blades by screwing a fastener through the through hole and into the threaded hole.

* * * * *